US007731634B2

(12) United States Patent
Stewart et al.

(10) Patent No.: US 7,731,634 B2
(45) Date of Patent: Jun. 8, 2010

(54) ELLIPTICAL EXERCISE EQUIPMENT WITH STOWABLE ARMS

(75) Inventors: Jonathan M. Stewart, Seattle, WA (US); David E. Dyer, Renton, WA (US); Robert Silbernagel, Sammamish, WA (US)

(73) Assignee: Precor Incorporated, Woodinville, WA (US)

( * ) Notice: Subject to any disclaimer, the term of this patent is extended or adjusted under 35 U.S.C. 154(b) by 1332 days.

(21) Appl. No.: 11/054,376

(22) Filed: Feb. 9, 2005

(65) Prior Publication Data

US 2006/0189445 A1 Aug. 24, 2006

(51) Int. Cl.
*A63B 22/04* (2006.01)

(52) U.S. Cl. ..... 482/52; 482/908

(58) Field of Classification Search ..... 482/51–53, 482/57, 62, 70–71, 139, 908; 292/194, 202, 292/210, 216, 229, 237, 280; 403/322.1, 403/322.3–322.4, 325; 74/500.5, 501.6, 74/502.1–502.2, 502.4, 502.6, 519, 523, 74/527, 551.2, 551.7; *A63B 22/04*
See application file for complete search history.

(56) References Cited

U.S. PATENT DOCUMENTS

| | | | | |
|---|---|---|---|---|
| 3,784,193 A | | 1/1974 | Simjian | 272/68 |
| 5,536,224 A | | 7/1996 | Hsieh | 482/51 |
| 5,779,599 A | | 7/1998 | Chen | 482/57 |
| 5,792,026 A | * | 8/1998 | Maresh et al. | 482/51 |
| 5,882,281 A | | 3/1999 | Stearns et al. | 482/51 |
| 5,895,339 A | | 4/1999 | Maresh | 482/51 |
| 5,906,123 A | * | 5/1999 | Spurr | 70/264 |
| 5,924,962 A | | 7/1999 | Rodgers, Jr. | 482/57 |
| 6,000,257 A | * | 12/1999 | Thomas | 70/279.1 |
| 6,045,488 A | | 4/2000 | Eschenbach | 482/52 |
| 6,047,614 A | * | 4/2000 | Beugelsdyk et al. | 74/502.2 |
| 6,077,196 A | | 6/2000 | Eschenbach | 482/51 |
| 6,077,198 A | | 6/2000 | Eschenbach | 482/52 |
| 6,090,014 A | | 7/2000 | Eschenbach | 482/52 |
| 6,273,845 B1 | * | 8/2001 | Liou | 482/63 |

(Continued)

FOREIGN PATENT DOCUMENTS

EP 1 250 945 A2 10/2002

(Continued)

*Primary Examiner*—Loan H Thanh
*Assistant Examiner*—Oren Ginsberg
(74) *Attorney, Agent, or Firm*—Terence P. O'Brien; Todd A. Rothe; Paul E. Schaafsma

(57) ABSTRACT

An exercise device includes a frame defining a longitudinal axis. A foot link includes a rearward portion that is constrained to move in an orbital path approximately parallel to the longitudinal axis and a forward portion that reciprocally engages the guide track. A swing arm is a pivotally connected to the frame, the swing arm having an upper portion extending above the pivotal connection and a lower portion disposed below the pivotal connection. An engagement mechanism having a first portion coupled to the lower portion and a second portion coupled to the forward portion of the foot link, such that a rearward force applied to the upper portion will produce a force on the forward portion having a downward component. An arm enabling/disabling mechanism is positioned on the elongate swing arm below the pivotal connection. The arm enabling/disabling mechanism can be effectuated by a user without the user interrupting exercise.

20 Claims, 14 Drawing Sheets

U.S. PATENT DOCUMENTS

| | | | | |
|---|---|---|---|---|
| 6,416,442 | B1 | 7/2002 | Stearns et al. | 482/52 |
| 6,575,877 | B2 | 6/2003 | Rufino et al. | 482/51 |
| 6,689,019 | B2 | 2/2004 | Ohrt et al. | 482/52 |
| 6,715,806 | B2 * | 4/2004 | Arlt et al. | 292/201 |
| 2001/0012811 | A1 | 8/2001 | Gordon | 482/70 |
| 2001/0051562 | A1 | 12/2001 | Stearns et al. | 482/51 |
| 2002/0016237 | A1 | 2/2002 | Schmidt | 482/70 |
| 2002/0119867 | A1 * | 8/2002 | Stearns et al. | 482/52 |
| 2002/0123411 | A1 | 9/2002 | Stearns et al. | 482/52 |
| 2002/0155927 | A1 | 10/2002 | Corbalis et al. | 482/52 |
| 2002/0193214 | A1 * | 12/2002 | Ish, III | 482/92 |
| 2005/0101445 | A1 * | 5/2005 | Chen | 482/52 |

FOREIGN PATENT DOCUMENTS

| | | | |
|---|---|---|---|
| WO | WO 01 00280 | A2 | 1/2001 |

* cited by examiner 8
20
126
132
132
126
90
80
84
94
121
121
123
123
130
130
7
141
141
7
136
136
127
127
8

ELLIPTICAL EXERCISE EQUIPMENT WITH STOWABLE ARMS

FIELD OF THE INVENTION

The present invention relates to exercise equipment.

BACKGROUND OF THE INVENTION

The benefits of regular aerobic exercise are well established. However, due to time constraints, inclement weather, and other reasons, many people are prevented from aerobic activities such as walking, jogging, running, and swimming. In response, a variety of exercise equipment has been developed for aerobic activity. It is generally desirable to exercise a large number of different muscles over a significantly large range of motion so as to provide for balanced physical development, to maximize muscle length and flexibility, and to achieve optimum levels of aerobic exercise. It is further advantageous for exercise equipment to provide smooth and natural motion, thus avoiding significant jarring and straining that can damage both muscles and joints.

While various exercise systems are known in the prior art, these systems suffer from a variety of shortcomings that limit their benefits and/or include unnecessary risks and undesirable features. For example, stationary bicycles are a popular exercise system in the prior art; however, these machines employ a sitting position that utilizes only a relatively small number of muscles, through a fairly limited range of motion. Cross-country skiing devices are also utilized to simulate the gliding motion of cross-country skiing. While cross-country skiing devices exercise more muscles than stationary bicycles, the substantially flat shuffling foot motion provided by the ski devices limits the range of motion of some of the muscles being exercised. Another type of exercise device simulates stair climbing. These devices exercise more muscles than stationary bicycles; however, the rather limited range of up-and-down motion utilized does not exercise the user's leg muscles through a large range of motion. Treadmills are still a further type of exercise device in the prior art. Treadmills allow natural walking or jogging motions in a relatively limited area. A drawback of the treadmill, however, is that significant jarring of the hip, knee, ankle and other joints of the body may occur through use of this device.

A further limitation of a majority of exercise systems in the prior art lies in the limits in the types of motions that they can produce. A relatively new class of exercise devices are capable of producing elliptical motion. Exercise systems create elliptical motion, as referred to herein, when the path traveled by a user's feet while using the exercise system follows an arcuate or ellipse-shaped path of travel. Elliptical motion is much more natural and analogous to running, jogging, walking, etc., than the linear-type, back and forth motions produced by some prior art exercise equipment.

Exercise devices that can provide arm and shoulder motions as well as elliptical foot motions are also desirable. Prior art devices utilize arm and shoulder motions that are linked to foot motions. These linked devices incorporate forced coordinated motion, where the motions of a user's feet are linked to the motions of a user's arms and shoulders. Thus, the user's feet are forced to move in response to the movement of the user's arms and shoulders (in substantially an equal and opposite amount), and vice versa. One drawback to these linked devices lies in the desire of certain users to utilize the foot motions without a corresponding utilization of the arm apparatuses. Because the arm apparatuses travel through a given path regardless of whether the user is exerting any force on the arm due to the force being exerted on the foot links, even where the arm apparatuses are not engaged the arm apparatuses continue in motion. This is at least bothersome to the user as these arm apparatuses are contained within close proximity to the user's body and reciprocate at a somewhat high rate of speed. One prior art device seeks to disable the arm apparatus altogether, however, this device suffers from the drawbacks of complexity of use and the need for the user or a technician to adjust the arm apparatus to either the enabled or disabled setting prior to and following use by a user.

What would thus be desirable is an exercise device that provides for smooth natural action, exercises a relatively large number of muscles through a large range of elliptical motion, employs arm, shoulder, and rotational movement, and provides for safety and stability. Such an exercise device would further allow a user to easily and efficiently choose to use or not to use the arm apparatus.

SUMMARY OF THE INVENTION

An exercise device in accordance with the principles of the present invention provides for smooth natural action, exercises a relatively large number of muscles through a large range of elliptical motion, employs arm, shoulder, and rotational movement, and provides for safety and stability. An exercise device in accordance with the principles of the present invention allows a user to easily and efficiently choose to use or not to use and efficiently stow the arm apparatus.

In accordance with the present invention, an exercise device is provided having a frame defining a longitudinal axis, the frame having a rearward portion and a forward portion. A foot link includes a rearward portion that is constrained to move in an orbital path approximately parallel to the longitudinal axis and a forward portion that reciprocally engages the guide track. A swing arm is a pivotally connected to the frame, the swing arm having an upper portion extending above the pivotal connection and a lower portion disposed below the pivotal connection. An engagement mechanism having a first portion coupled to the lower portion of the swing arm and a second portion coupled to the forward portion of the foot link, such that a rearward force applied to the upper portion of the swing arm will produce a force on the forward portion of the foot link having a downward component. An arm enabling/disabling mechanism is positioned on the elongate swing arm below the pivotal connection. The arm enabling/disabling mechanism can be effectuated by a user without the user interrupting exercise.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE INVENTION

While an exemplary embodiment of the invention has been illustrated and described, it will be appreciated that various changes can be made therein without departing from the spirit and scope of the invention.

Figure 1:
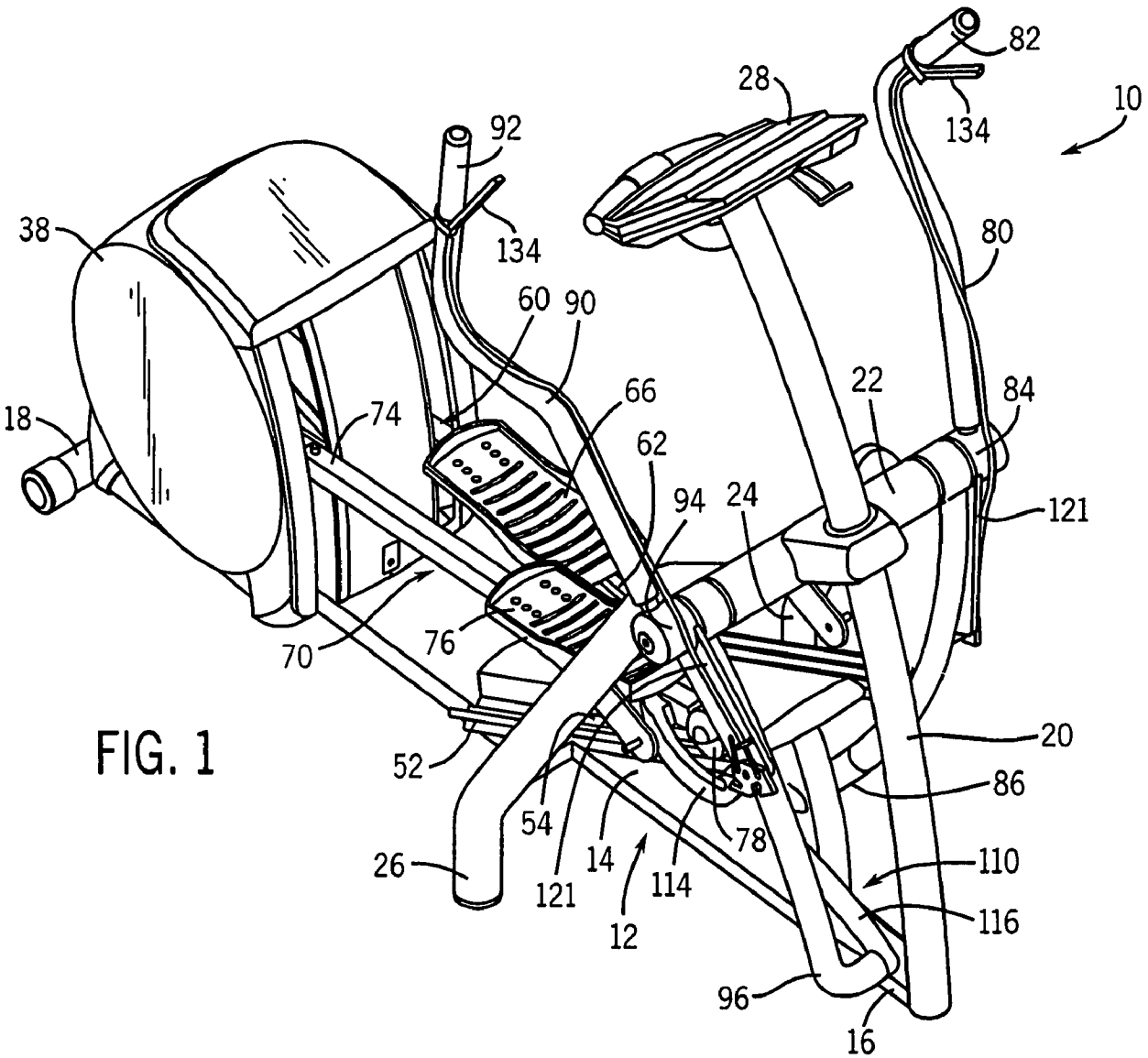
FIG. 1 illustrates an elevated front perspective view of an exercise device in accordance with the principles of the present invention.
Figure 2:
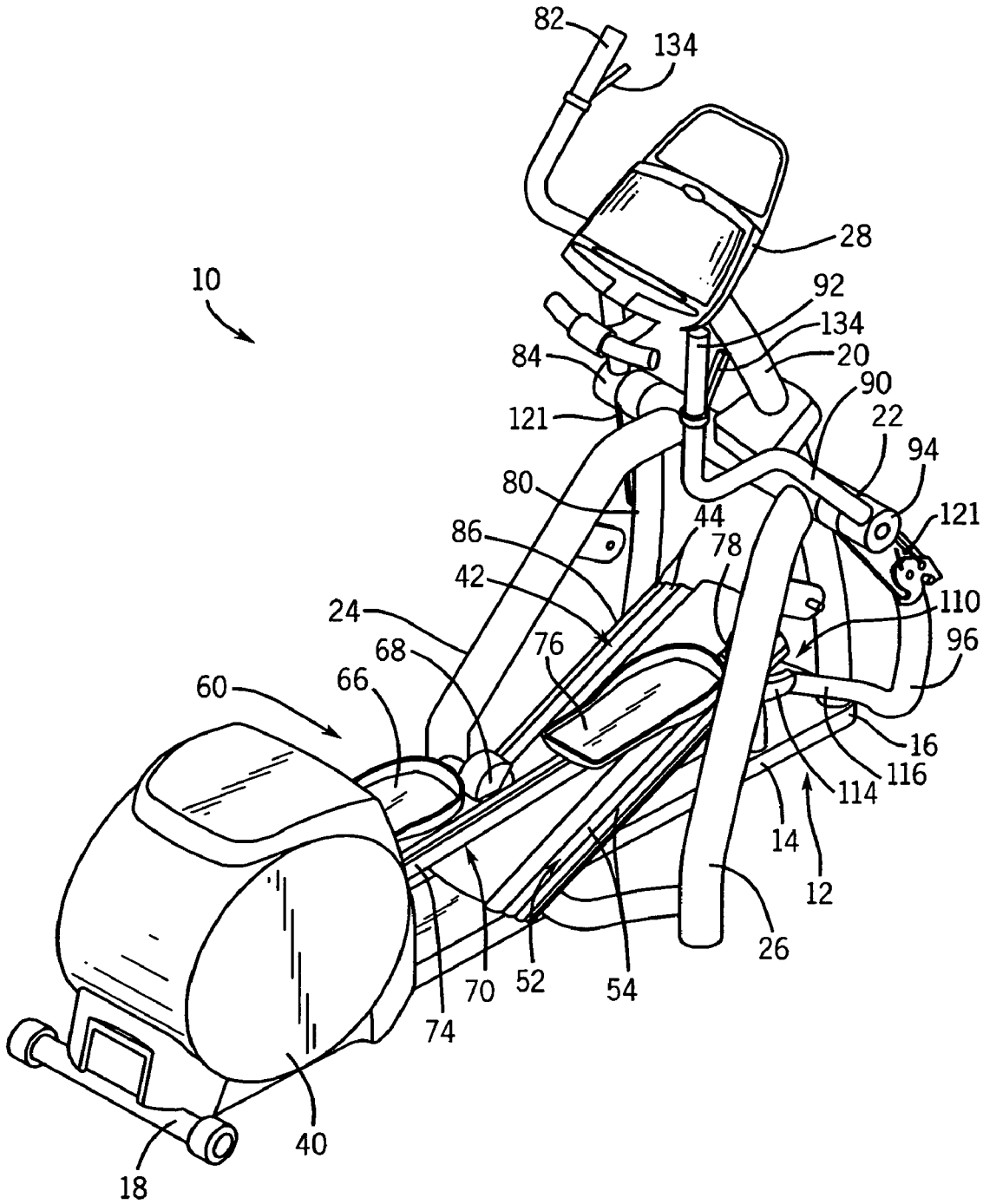
FIG. 2 illustrates an elevated rear perspective view of the exercise device of FIG. 1.
Figure 3:
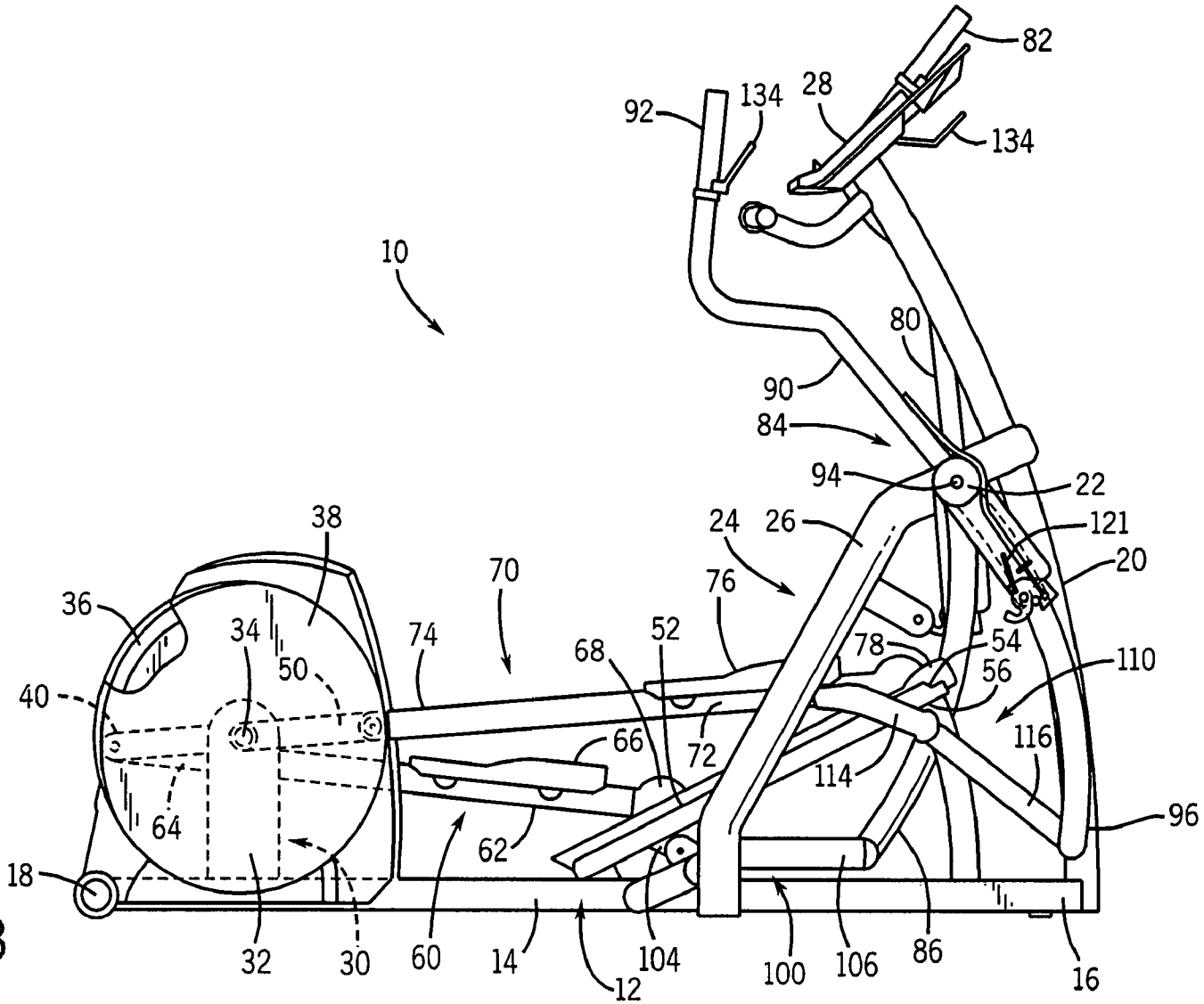
FIG. 3 illustrates a side view of the exercise device of FIG. 1.

FIGS. 1-3 illustrate an embodiment of an exercise device 10 constructed in accordance with the principles of the present invention that exercises both the upper and lower body in associated motion. Briefly described, the exerciser 10 includes a frame 12 that has a forward upright member 20. The forward upright member 20 extends upwardly and curves slightly rearwardly from a substantially horizontal, longitudinal central member 14 of the frame 12. Left and right axle mounts 30, 32 extend upwardly towards the rear region of the frame 12. The axle mounts 30, 32 support a transverse axle 34 that is preferably operatively connected to a flywheel 36. The left and right ends of the transverse axle 34 rotatably engage left and right crank arm assemblies 40, 50. Left and right foot links 60, 70 each include a forward portion 62, 72, a rearward portion 64, 74, and a foot support portion 66, 76 therebetween. The rearward portions 64, 74 of the foot links 60, 70 engage the crank arm assemblies 40, 50 such that the foot support portion 66, 76 of the foot links travel in an arcuate reciprocal path as the transverse axle 34 rotates.

The forward portions 62, 72 of the foot links 60, 70 preferably are supported by rollers 68, 78, which engage guide tracks 42, 52 that are mounted to the frame 12. In one embodiment of the present invention, the guide tracks can be statically mounted to the frame 12. In an alternative embodiment, the guide tracks can incorporate a mechanism such as a motor (not shown) and a lead screw (not shown) for selectively adjusting the inclination of the guide tracks. The forward portions 62, 72 of the foot links 60, 70 are operatively connected to engagement assemblies 100, 110, which in turn are operatively connected to the coupling regions 86, 96 of left and right swing arm mechanisms 80, 90, respectively. The swing arm mechanisms 80, 90 are rotatably connected to the forward upright member 20 of the frame 12 at their respective pivot points 84, 94. The swing arm mechanisms 80, 90 further contain left and right hand-gripping portions 82, 92. Each engagement assembly 100, 110 includes an abutment arm 106, 116, and a curved attachment link 104, 114, which together prevent the derailment of the foot link rollers 68, 78 from the guide tracks 42, 52.

More particularly, the frame 12 includes the longitudinal central member 14 that terminates at forward and rearward portion portions 16, 18. Preferably, the forward portion 16 of the frame 12 simply terminates at the end of the longitudinal central member 14, while the rearward portion 18 terminates as a relatively shorter transverse member. Ideally, but not essentially, the frame 12 is composed of tubular members that are relatively light in weight but that provide substantial strength and rigidity. The frame 12 may also be composed of solid members that provide the requisite strength and rigidity while maintaining a relatively lightweight.

The forward upright member 20 extends upwardly and slightly rearwardly from the forward portion 16 of the floor-engaging frame 12. Preferably, the upright member 20 is slightly rearwardly curved; however, the forward member 20 may be configured at other upward angles without departing from the scope of the present invention. A relatively short, transversely oriented crossbar member 22 is connected to the forward upright member 20. Left and right balance arms 24, 26 depend downwardly from each end of the crossbar member 22 to engage the floor on each side of the longitudinal central member 14 near the forward portion of the exercise device 10, thereby increasing stability. Ideally, but not essentially, these members are composed of a material similar to that described above, and are formed in quasi-circular tubular configurations.

Preferably, a view screen 28 is securely connected to the upper portion of the forward upright member 20, at an orientation that is easily viewable to a user of the device 10. Instructions for operating the device as well as courses being traveled may be located on the view screen 24 in an exemplary embodiment. In some embodiments of the present invention, electronic devices may be incorporated into the exerciser device 10 such as timers, odometers, speedometers, heart rate indicators, energy expenditure recorders, controllers, etc. This information may be routed to the view screen 28 for ease of viewing for a user of the device 10.

In the exemplary embodiment shown in FIG. 3, the axle mounts 30, 32 are located toward the rearward portion 18 of the frame 12. The axle mounts 30, 32 are attached to the frame 12 and extend approximately upward from the substantially horizontal, longitudinal central member 14. The transverse axle 34 is rotatably housed in the upper region of the axle mounts 30, 32. These regions of the axle mounts 30, 32, which house the ends of the transverse axle 34, contain low friction engaging systems (not shown), such as bearing systems, to allow the transverse axle 34 to rotate with little resistance within the housing in the axle mounts 30, 32.

Referring again to the exemplary embodiment shown in FIG. 3, the transverse axle 34 connects to a flywheel 36 contained within a center housing 38. Such flywheels are known in the art. However, in other embodiments, the transverse axle 34 may not incorporate a flywheel 36 and/or central housing 38, without departing from the scope of the present invention (provided that the foot links 60, 70 are coupled to one another in some fashion, albeit directly or indirectly). The transverse axle 34 may also be operatively connected to a capstan-type drive (not shown) in some embodiments, to allow the axle 34 to rotate in only one direction.

The elliptical motion exerciser 10 further contains longitudinally extending left and right foot links 60, 70. As shown in FIGS. 1-3, the foot links 60, 70 are illustrated in the shape of elongated, relatively thin beams. The foot links 60, 70 are aligned in approximately parallel relationship with the longitudinal central member 14 of the frame 12. The foot support portions 66, 76 are positioned near the forward portion of the foot links 60, 70, and provide stable foot placement locations for the user of the device. In some exemplary embodiments the foot support portions 66, 76 are configured to form toe straps and/or toe and heel cups (not shown) which aid in forward motion recovery at the end of a rearward or forward striding motion of a user's foot.

Left and right crank arm assemblies 40, 50 couple the rearward portions 64, 74 of the foot links 60, 70 to the ends of the transverse axle 34. In one embodiment of the present invention shown in FIGS. 1-3, the crank arm assemblies 40, 50 are comprised of single left and right crank arm members. In this exemplary embodiment the proximal portions of the crank arm members 40, 50 engage the ends of the transverse axle 34, while the distal portions of the crank arm members 40, 50 are rotatably connected to the rearward portions 64, 74 of the foot links 60, 70. In this configuration, the rearward portions 64, 74 of the foot links 60, 70 orbit about the transverse axle 34 as the axle rotates, and the foot support portions 66, 76 of the foot links 60, 70 travel in a reciprocal, elliptical path of motion; however, the elliptical path of the foot support portions 66, 76, and indeed the motion of the entire foot links 60, 70 can be altered into any number of configurations by changing the composition or dimensions of the crank arm assemblies 40, 50. For example, the length of the single left and right crank arms shown in FIG. 1 can be lengthened or shortened to modify the path of the foot links 60, 70. Further, the left and right crank arm assemblies 40, 50 can be composed of multiple crank arm member linkages to alter the path of travel of the foot links 60, 70 in a wide variety of aspects.

In an alternate embodiment of the present invention the rearward portions 64, 74 of the foot links 60, 70 are rotationally connected directly to a flywheel which functions to couple the foot links 60, 70 to a pivot axis (equivalent to the axis of the transverse axle 34) and permit rotation thereabout. In this embodiment, the flywheel is preferably a double flywheel that supports rotation about a central axis. Various mechanical arrangements may be employed to embody the crank arm assemblies 40, 50 in operatively connecting the foot links 60, 70 to each other. Such variations may include a larger flywheel, a smaller flywheel, or may eliminate the flywheel entirely and incorporate a cam system with connecting linkage, provided that the foot links are coupled so as to permit an arcuate path of travel by the foot support portions 66, 76 of the foot links 60, 70.

Figure 4:
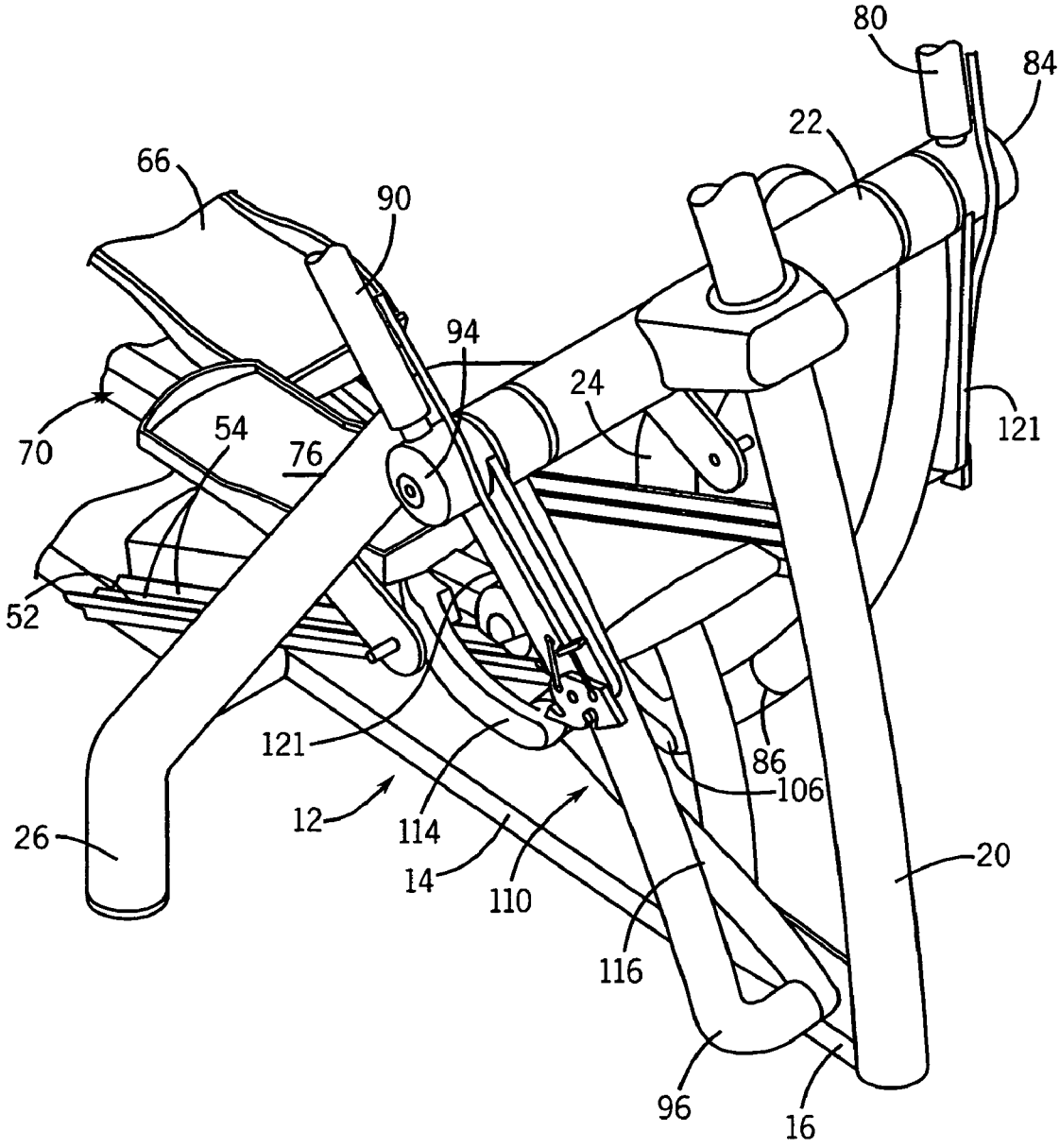
FIG. 4 illustrates a close-up perspective view of a portion of the exercise device of FIG. 1, which includes the abutment arm and curved attachment link of the engagement assembly.
Figure 5:
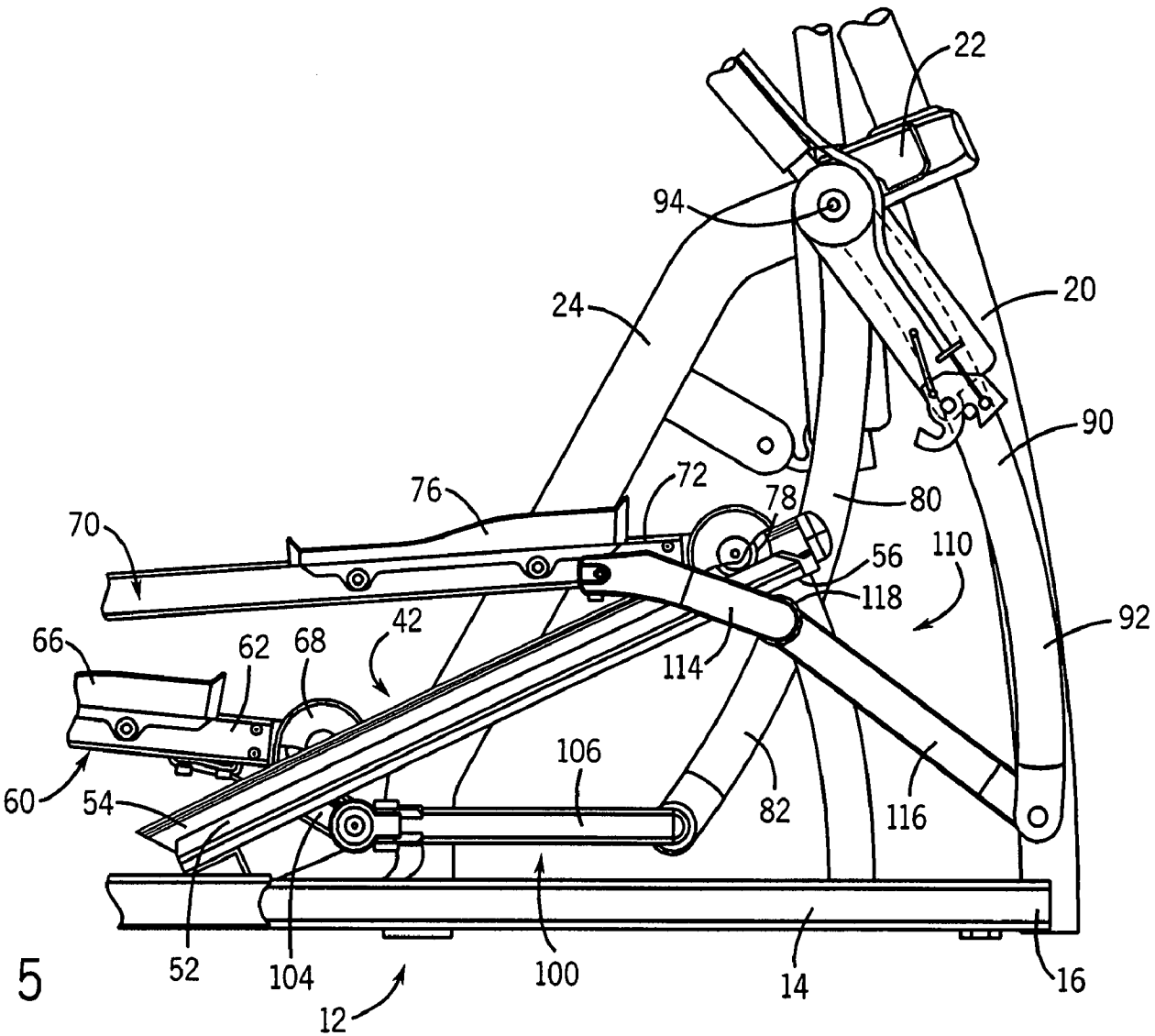
FIG. 5 illustrates a close-up side view of the exercise device of FIG. 1, which includes the abutment arm and curved attachment link of the engagement assembly.

As most clearly shown in FIGS. 4-5, the exerciser device 10 further contains left and right guide tracks 42, 52. The guide tracks 42, 52 can be completely separate members, or can be part of one single connected unit (as shown in FIGS. 4 and 5). The guide tracks 42, 52 attach to the longitudinal central member 14 of the frame 12 at an angled inclination. In one embodiment, the angle of inclination is approximately 30 degrees. Preferably, the upper surface of the guide tracks 42, 52 is shaped to contain two longitudinally extending, adjacent engagement grooves 44, 54. These engagement grooves 44, 54 give the upper surface of the guide tracks 42, 52 a generally "W-shaped" cross-sectional configuration. The engagement grooves 44, 54 are specifically sized and shaped to correspondingly mate with the rollers 68, 78 of the foot links 60, 70 in order to assist in the lateral containment of the rollers 68, 78 on the guide tracks. In addition, the lower surface of the guide tracks 42, 52 preferably contain longitudinally extending stabilizing troughs 56 (see FIG. 4).

The left and right forward portions 62, 72 of the foot links 60, 70 terminate in left and right engagement rollers 68, 78. The left and right engagement rollers 68, 78 ride along the above-described grooves 44, 54 of the guide tracks 42, 52. Preferably, the engagement rollers 68, 78 are actually pairs of rollers. The engagement rollers 68, 78 rotate about axles that are affixed to the forward portions 62, 72 of the foot links 60, 70. During use of the exercise device 10, the engagement rollers 68, 78 at the front of the foot links 60, 70 translate back and forth the length of the guide tracks 42, 52 in rolling engagement within the grooves 44, 54, as the foot support portions 66, 76 of the foot links 60, 70 travel in an arcuate path of motion, and the rearward portions 64, 74 of the foot links 60, 70 rotate about the transverse axle 34. In an alternate embodiment of the present invention, the engagement rollers 68, 78 could be replaced with sliding engagement mechanisms without departing from the scope of the present invention.

As shown in FIGS. 4-5, left and right engagement assemblies 100, 110 operatively connect the forward portions 62, 72 of the foot links 60, 70 to the coupling regions 86, 96 of swing arm mechanisms 80, 90. Preferably, each of the engagement assemblies 100, 110 includes a curved attachment link 104, 114, and an abutment arm 106, 116. In alternate embodiments, either more or fewer members can be utilized to produce the engagement assemblies 100, 110 without departing from the scope of the present invention. In an exemplary embodiment, the abutment arms 106, 116 each have an abutment knob 108, 118. The abutment knobs 108, 118 are designed to withstand intermittent contact with the stabilizing troughs 56 on the lower surface of the guide tracks 42, 52 during use of the exercise device 10.

In alternate embodiments of the present invention, the engagement assemblies 100, 110 could be configured such that the abutment knobs 108, 118 were located on the curved attachment links 104, 114 (or the abutment knobs could be deleted altogether), without departing from the scope of the present invention. Further, depending on the exact configuration and number of links utilized in the engagement assemblies 100, 110, the curved attachment links 104, 114 may not even be curved, but rather may be linear attachment links. Each curved attachment link 104, 114 is rotatably coupled to an abutment arm 106, 116. Each curved attachment link 104, 114 is fixedly secured to the forward portion 62, 72 of a foot link 60, 70, and each abutment arm 106, 116 is rotatably coupled to the coupling region 86, 96 of a swing arm mechanism 80, 90.

Referring again to FIGS. 1-3, the exerciser device 10 contains left and right swing arm mechanisms 80, 90. Respectively, each swing arm mechanism 80, 90 contains a hand-gripping portion 82, 92, a pivot point 84, 94, and a coupling region 86, 96. The coupling regions 86, 96 of the swing arm mechanisms 80, 90 rotatably connect to the engagement assemblies 100, 110, and turn to the foot support portions 66, 76 of the foot links 60, 70. The pivot points 84, 94 rotatably secure the swing arm mechanisms 80, 90 to each end of the crossbar member 22 of the frame 12.

The hand-gripping portions 82, 92 of the swing arm mechanisms 80, 90 are grasped by the hands of the individual user, and allow upper body arm and shoulder exercising motions to be incorporated in conjunction with the reciprocal, elliptical exercising motion traced out by the user's feet. As can be more readily understood with reference to FIGS. 1-3, the linking of the swing arm mechanisms 80, 90 to the foot links 60, 70, via the engagement assemblies 100, 110, and the rotational securement of the swing arm mechanisms 80, 90 to the forward upright member 20 of the frame 12 at the pivot points 84, 94, results in generally rearward, arcuate motion of a hand-gripping portion being correspondingly linked to a generally forward, arcuate motion of a respective foot support portion, and vice versa.

Figure 14:
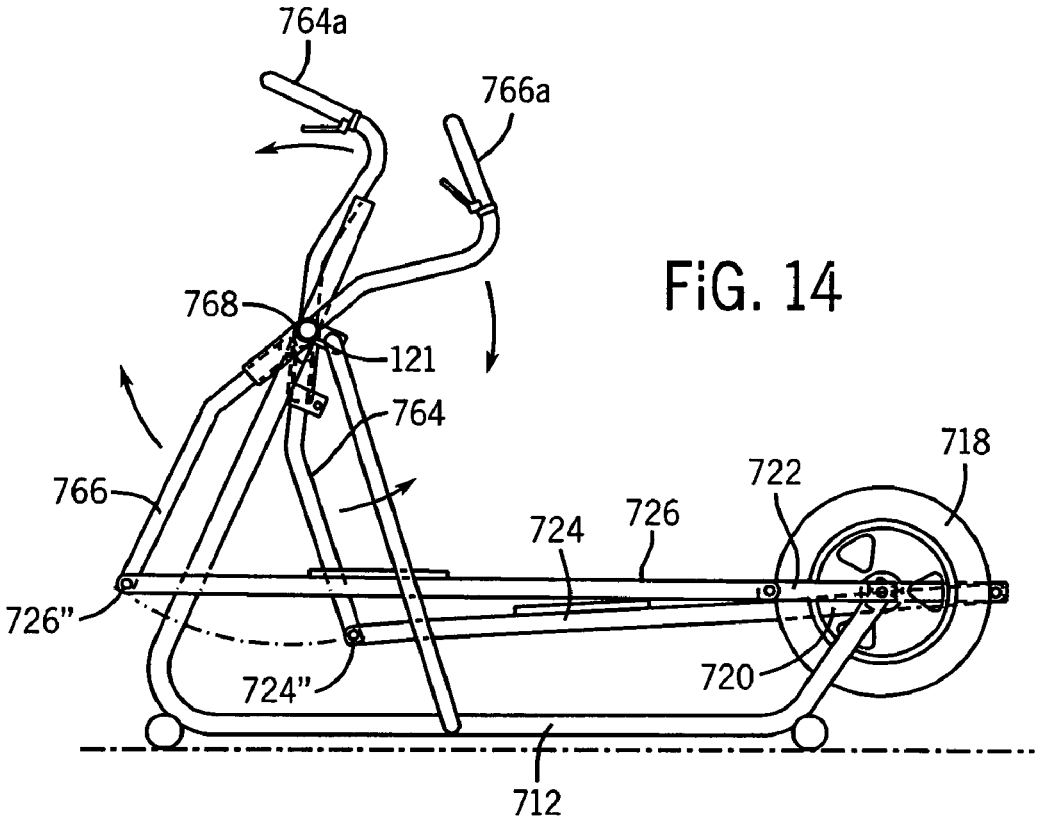
FIGS. 14 and 15 illustrate elevated side perspective views of an alternative exercise device in accordance with the principles of the present invention.
Figure 15:
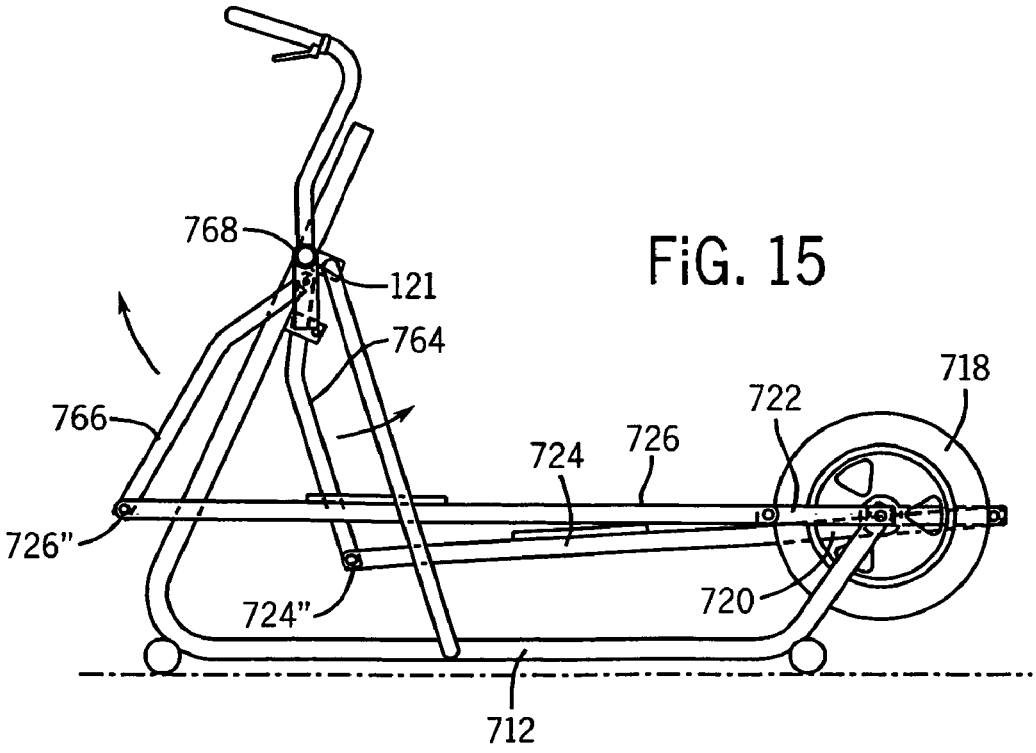

An alternative exemplary exercise device that can incorporate the principles of the present invention is set forth in FIGS. 14 and 15. The exercise device includes a frame 712 having a pivot axis, X, defined therein, as for example by a shaft passing through, and supported by the frame 712. In this exemplary embodiment, the shaft has a flywheel 718 supported thereupon for rotation about the pivot axis X. The exercise device further includes a first and second bell crank 720, 722 pivotally mounted for rotation about the axis X. First and second foot links, 724, 726 are provided. The foot links 724, 726 are generally elongated members having a first portion pivotally connected to the bell cranks 722, 720 in such a manner so as to permit travel of the first portions of the foot links 724 and 726 in an arcuate path of travel about the pivot axis X at a predetermined length corresponding to the length of the bell cranks 720, 722.

A pair of arm links 764 and 766 is provided. Each arm link 764, 766 is pivotally supported by the frame 712 at support point 768. The arm links 764, 766 are also pivotally coupled to the ends 724", 726" of the foot links 724, 726. As indicated by phantom line Y, pivoting of the arm links 764, 766 about the support point 768 causes the second ends 724", 726" of the foot links 724, 726 to reciprocate along the curved path Y. The arm links 764, 766 also include handle portions **764*a*, 766*a*** associated therewith. These handle portions may be configured to be gripped by a user and, during the operation of the device they also reciprocate, thereby providing upper body exercise.

Figure 6:
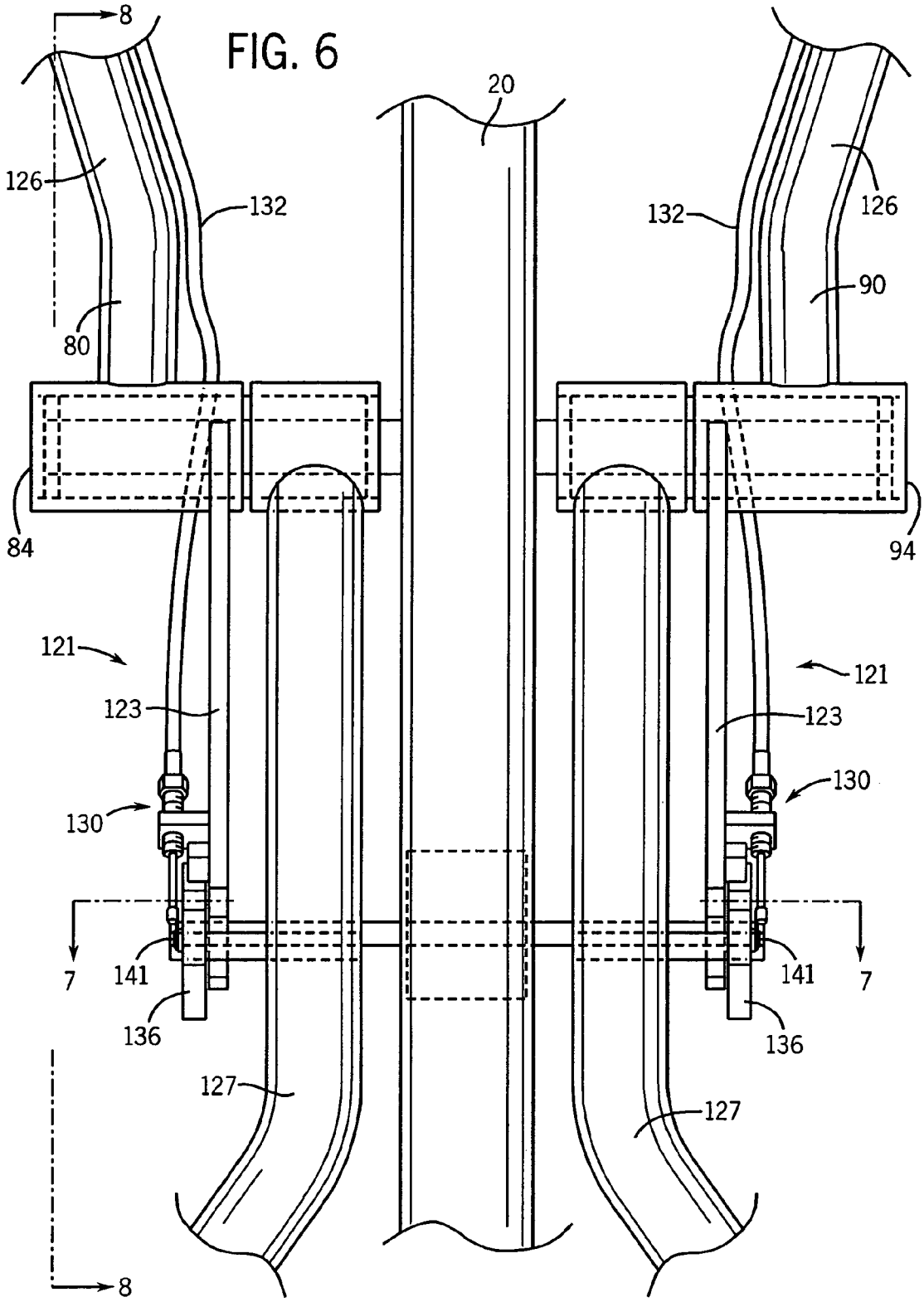
FIG. 6 is a front, elevated view of an arm enabling/disabling mechanism in accordance with the principles of the present invention with the arm mechanisms in the enabled position.

An exercise device that is constructed in accordance with the present invention allows a user to easily and efficiently choose to use or not to use the arm apparatus. Referring to FIGS. 6-10, an arm enabling/disabling mechanism 121 in accordance with the principles of the present invention is seen. FIG. 6 is a front, elevated view of the arm enabling/disabling mechanism 121 of the present invention. FIGS. 7-10 are close-up side views of the arm enabling/disabling mechanism 121 of the present invention. For ease of reference, only a single arm enabling/disabling mechanism 121 contained on one side of the pivot point connection 84, 94 will be described.

A bracket 123 is securely connected to the arm mechanism and extends downwardly on each side of the pivot point connection 84, 94. The bracket 123 provides a pivotal connection 94 between an upper portion 126 and a lower portion 127 of the swing arm mechanism 90. While this exemplary arm enabling/disabling mechanism 121 is shown and described as positioned connected to the arm mechanism at the approximate midpoint of the arm mechanism, it should be appreciated that the position of the arm enabling/disabling mechanism is not critical to the principles of the present invention so long as the positioning of the arm enabling/disabling mechanism allows the arm mechanisms to be disengaged from the leg potion.

The bracket 123 secures a cable assembly 130 having a cable 132 connected at one end to an actuator 134 contained on the arm mechanism 90 proximal to the hand-gripping portions 92 (seen in FIGS. 1-3). In one embodiment, the actuator 134 is a hand lever as depicted in FIGS. 1-3; in additional embodiments, alternative actuators such as but not limited to push rods, push buttons, rotary hand member, etc. can be utilized. The opposite end of the cable 132 is connected to a latching plate 136 by a suitable securing apparatus 138. The latching plate 136 is pivotally secured to the bracket 123 around a latching plate pivot axis 141. The latching plate 136 includes a biasing arm 143 having a biasing member 145 such as a spring connecting the biasing arm 143 to the bracket 123 by suitable securing apparatus 147, 149. Thus, the latching plate 136 is biased around the latching plate pivot axis 141 in opposition to the cable 132, thereby providing biasing resistance to the cable 132.

Figure 7:
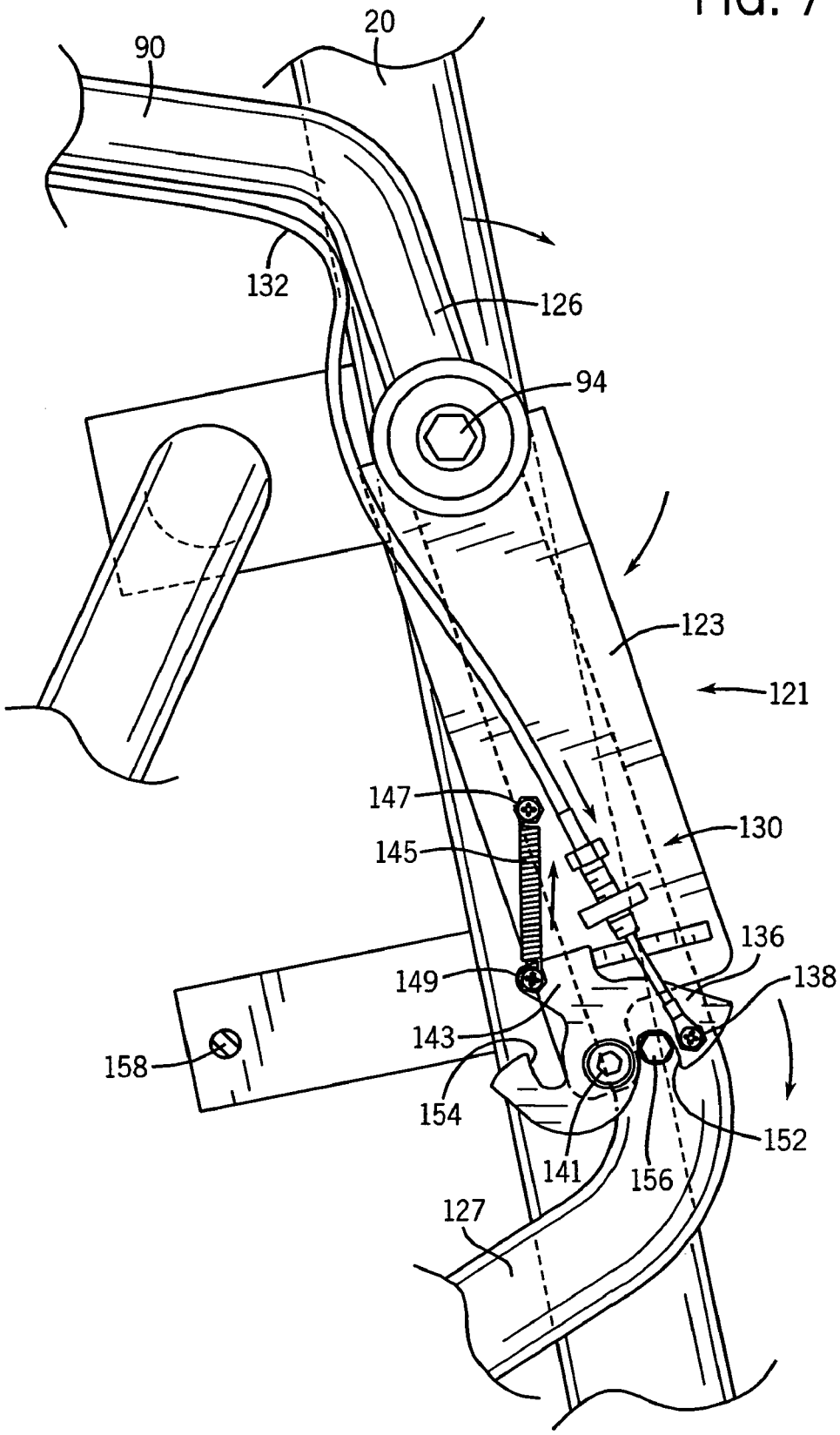
FIG. 7 is a close-up side view of the arm enabling/disabling mechanism of FIG. 6.

The latching plate 136 further defines two slots 152, 154. The first slot 152 secures the arm enabling/disabling mechanism 121 in the enabled position; the second slot 154 secures the arm enabling/disabling mechanism 121 in the disabled position. Proximal to the latching plate 136 in the enabled position an outwardly extending enable pin 156 extends from the lower portion 127 of the swing arm mechanism 90. The outwardly extending enable pin 156 is adapted to coordinate with the first slot 152 defined in the latching plate 136. In FIG. 7, the swing arm mechanism 90 is in the enabled position and thus the arm enabling/disabling mechanism 121 securely latches the outwardly extending enable pin 156 into the first slot 152 of the latching plate 136. The biasing member 145 biases the latching plate 136 such that the outwardly extending enable pin 156 is securely engaged in the first slot 152.

Figure 8:
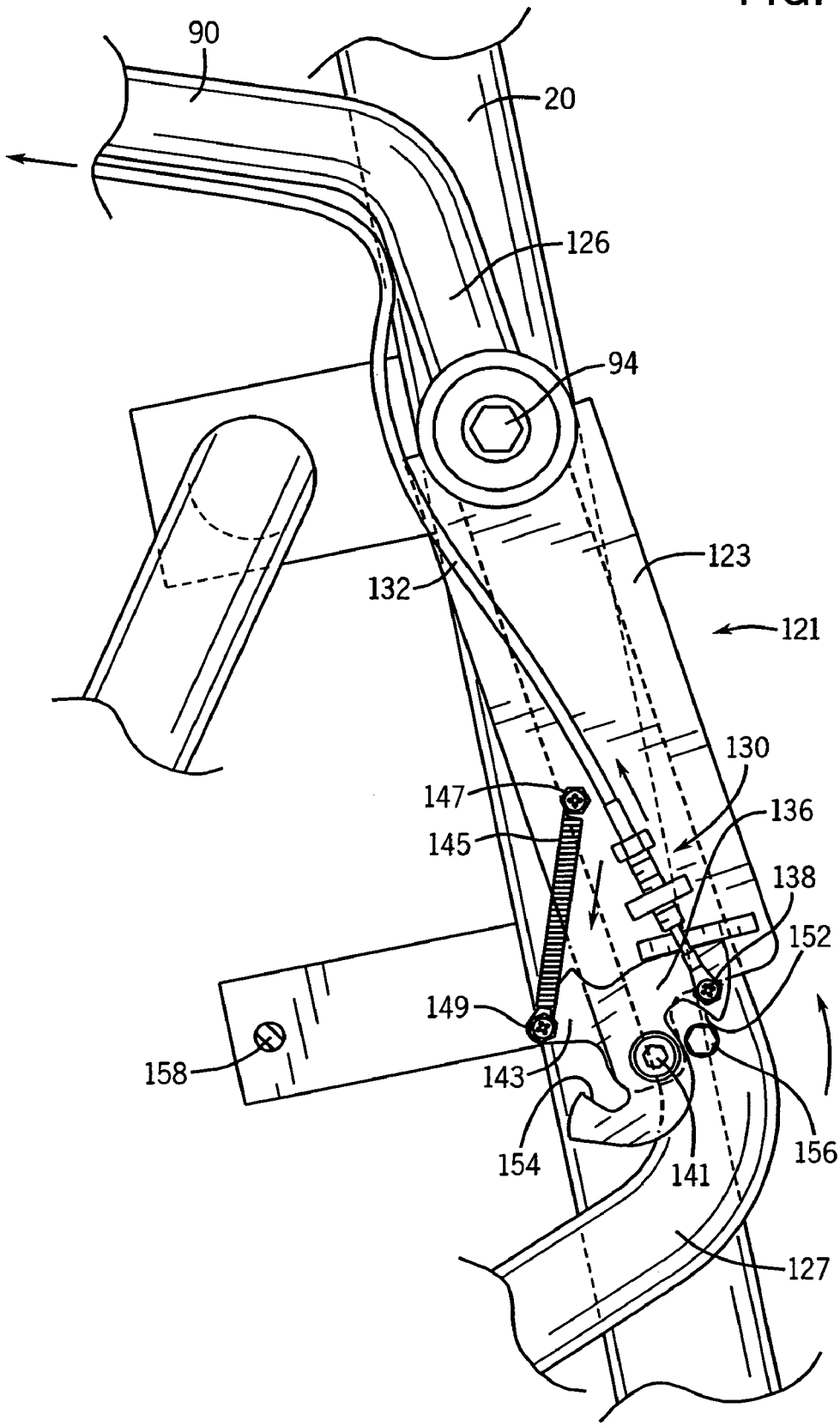
FIG. 8 is a close-up side view of the enabling/disabling mechanism of FIG. 6 with the arm mechanisms in between the enable and disabled positions.
Figure 9:
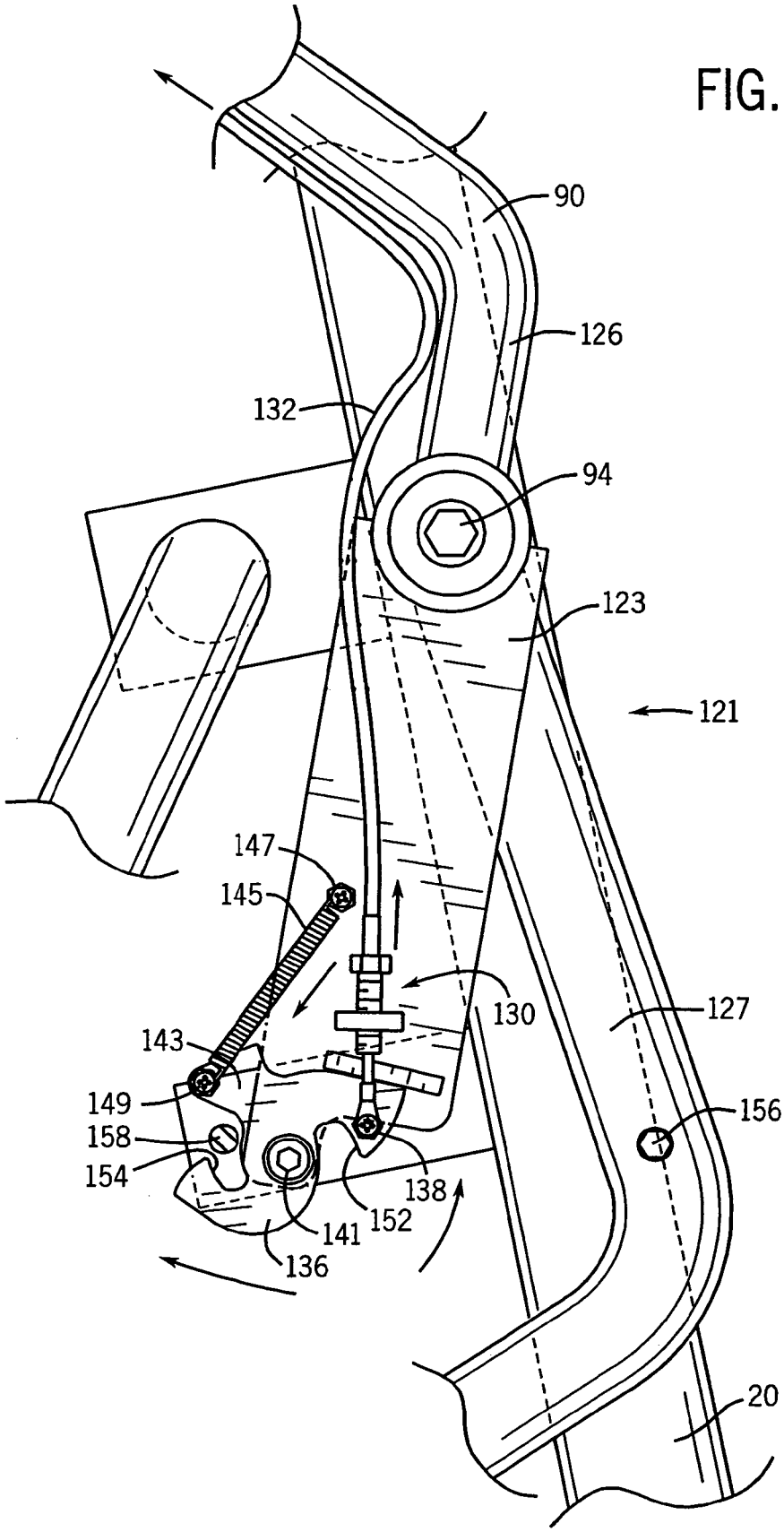
FIG. 9 is a close-up upper view of the enabling/disabling mechanism of FIG. 6 with the arm mechanisms in between the enable and disabled positions.

FIGS. 8 and 9 are close-up views of the enabling/disabling mechanism of FIG. 6 with the swing arm mechanism 90 in between the enable and the disabled positions. In this position, the user has actuated actuator 134 thereby causing the cable 132 to pull against the biasing member 145. This causes the latching plate 136 to rotate about the latching plate pivot axis 141, thereby disengaging the outwardly extending enable pin 156 from the first slot 152 of the latching plate 136. With the outwardly extending enable pin 156 disengaged from the first slot 152 of the latching plate 136, the user is free to pivot the swing arm mechanism 90 forward (away from the user) about pivotal connection 94 to the disabled position.

Figure 10:
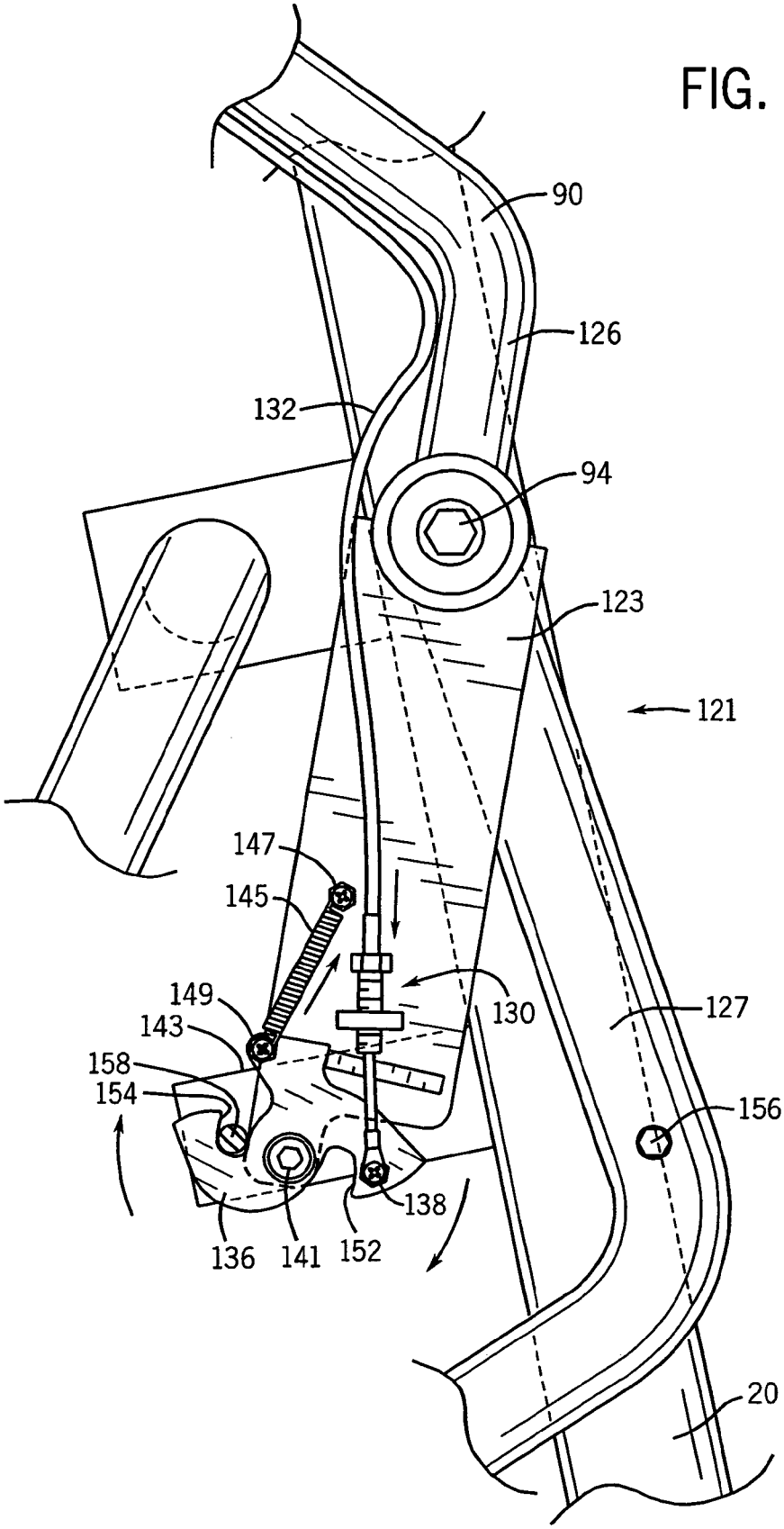
FIG. 10 is a close-up upper view of the enabling/disabling mechanism of FIG. 6 with the arm mechanisms in the disabled position.

FIG. 10 is a close-up upper view of the enabling/disabling mechanism 121 of FIG. 6 with the swing arm mechanism 90 in the disabled position. Proximal to the latching plate 136 in the disabled position, an outwardly extending disable pin 158 extends from the exercise device. When the hand-gripping portion 92 of the swing arm mechanism 90 has been extended forward with the actuator 134 activated, the latching plate 136 extends rearward and receives the outwardly extending disable pin 158 in the second slot 154. Once the second slot 154 receives the disable pin 158, the actuator 134 can be released to cause the disable pin 158 to be releasably secured in the second slot 154. The latching plate 136 biasing member 145 biases latching plate 136 against the outwardly extending disable pin 158 to secure the swing arm mechanism 80 in the disabled position. Alternative latching plate configurations for selectably and releasably securing the plate to the disable and enable pins are also contemplated, such as a slop or play free fastener, a linear or slidable fastener, a rotatable or pivotable fastener, a spring-loaded fastener, and combinations thereof. In a further embodiment, a releasable locking mechanism could be employed to further secure the outwardly extending enable pins 156, into the slots 152, 154, 158.

Figure 11:
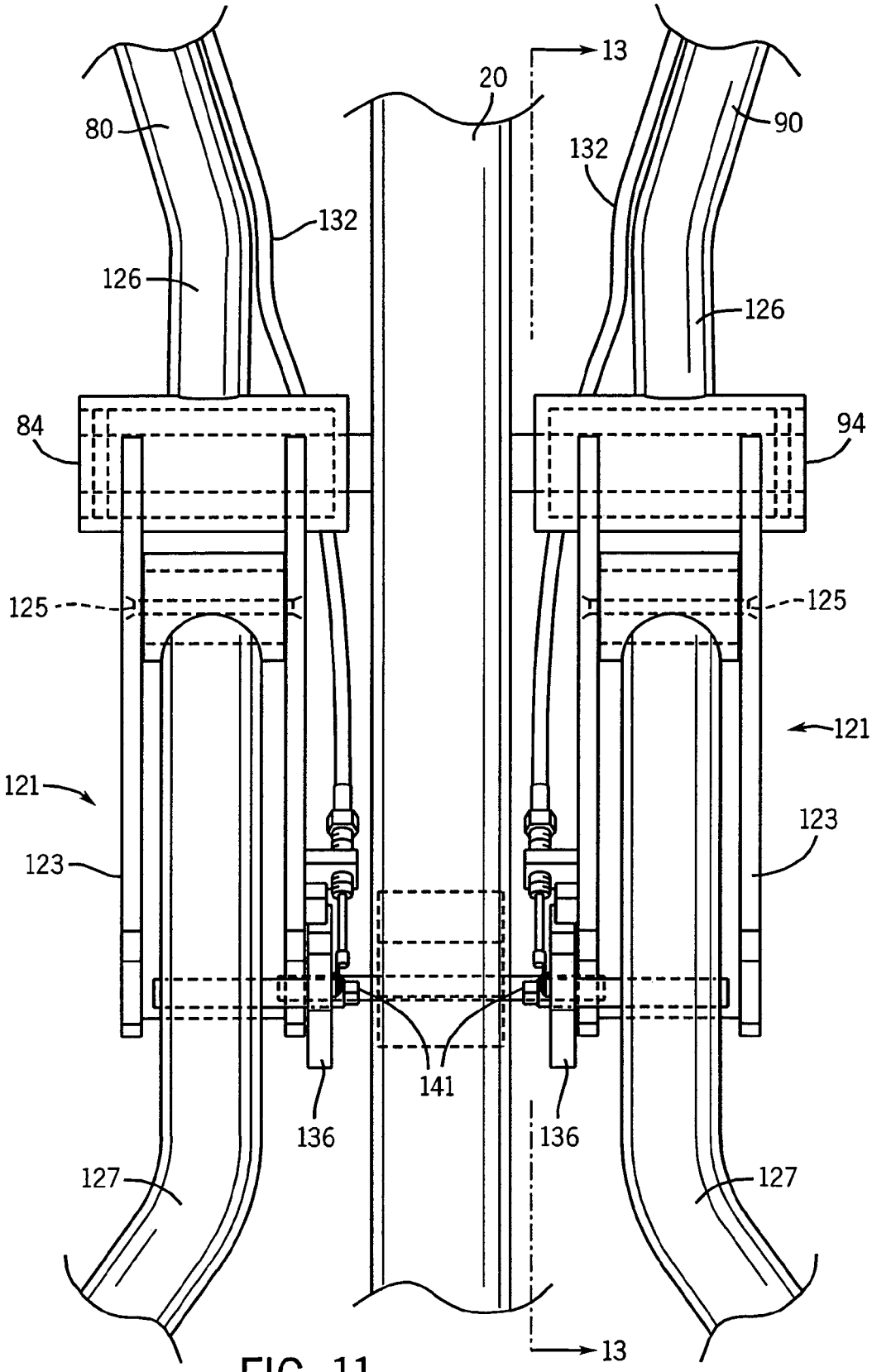
FIG. 11 illustrates an alternative arm enabling/disabling mechanism in accordance with the principles of the present invention.
Figure 12:
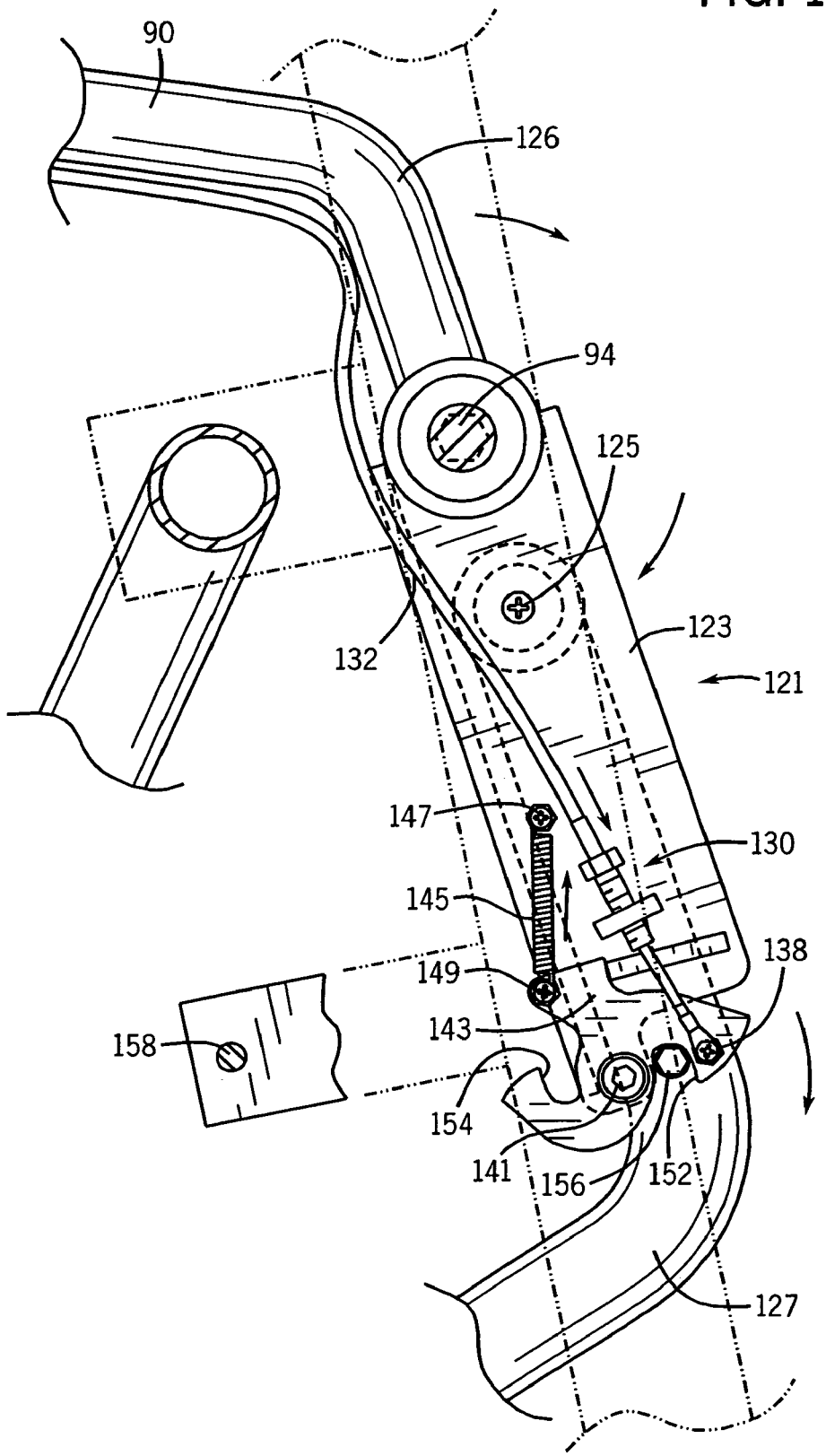
FIG. 12 is a close-up upper view of the enabling/disabling mechanism of FIG. 11 with the arm mechanisms in between the enable and disabled positions.
Figure 13:
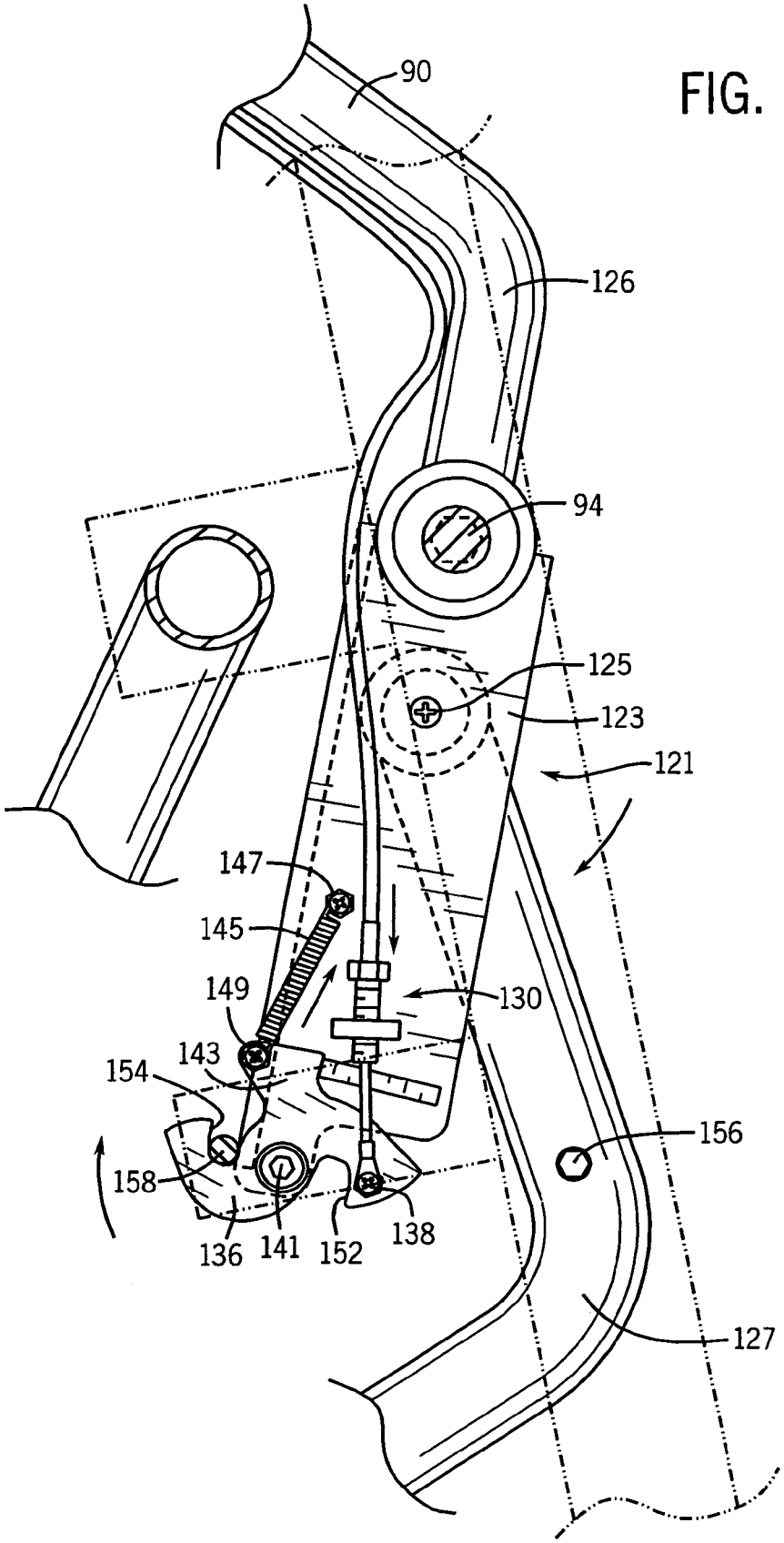
FIG. 13 is a close-up upper view of the enabling/disabling mechanism of FIG. 11 with the arm mechanisms in the disabled position.

Referring to FIGS. 11-13, a preferred embodiment of an arm enabling/disabling mechanism 121 in accordance with the principles of the present invention is seen. In FIGS. 11-13, like elements are designated with the same numerals. FIG. 11 is a front, elevated view of the preferred embodiment of an arm enabling/disabling mechanism 121 in accordance with the principles of the present invention. FIGS. 12 and 13 are close-up side views of the preferred embodiment of an arm enabling/disabling mechanism 121 in accordance with the principles of the present invention is seen. Again, for ease of reference only a single arm enabling/disabling mechanism 121 contained on one side of the pivot point connection 84, 94 will be described.

A bracket 123 is securely connected to the arm mechanism and extends downwardly on each side of the pivot point connection 84, 94. In the preferred embodiment of an arm enabling/disabling mechanism 121 in accordance with the principles of the present invention, the bracket 123 defines extends on both the inner side and the outer sides of the swing arm mechanism 90 in order to provide a second pivot point 125. This second pivot point 125 provides a pivotal connection between the bracket 123 and a lower portion 127 of the swing arm mechanism 90 in addition to a pivotal connection 94 between the bracket 123 and the upper portion 129 of the swing arm mechanism 90. By providing this two pivot point connection among the lower portion 127 and the upper portion 129 of the swing arm mechanism 90, the preferred embodiment of an arm enabling/disabling mechanism 121 of the present invention balances the forces applied on the swing arm mechanism 90 thereby increasing the durability of the device. Again, while this exemplary arm enabling/disabling mechanism 121 is shown and described as positioned connected to the arm mechanism at the approximate midpoint of the arm mechanism, it should be appreciated that the position of the arm enabling/disabling mechanism is not critical to the principles of the present invention so long as the positioning of the arm enabling/disabling mechanism allows the arm mechanisms to be disengaged from the leg portion.

The bracket 123 secures a cable assembly 130 having a cable 132 connected at one end to an actuator 134 contained on the arm mechanism 90 proximal to the hand-gripping portions 82. The opposite end of the cable 132 is connected to a latching plate 136 by a suitable securing apparatus 138. The latching plate 136 is pivotally secured to the bracket 123 around a latching plate pivot axis 141. The latching plate 136 includes a biasing arm 143 having a biasing member 145 such as a spring connecting the biasing arm 143 to the bracket 123 by suitable securing apparatus 147, 149. Thus, the latching plate 136 is biased around the latching plate pivot axis 141 in opposition to the cable 132, thereby providing biasing resistance to the cable 132.

The latching plate 136 further defines two slots 152, 154. The first slot 152 secures the arm enabling/disabling mechanism 121 in the enabled position; the second slot 154 secures the arm enabling/disabling mechanism 121 in the disabled position. Proximal to the latching plate 136 in the enabled position an outwardly extending enable pin 156 extends from the lower portion 127 of the swing arm mechanism 80. The outwardly extending enable pin 156 is adapted to coordinate with the first slot 152 defined in the latching plate 136. In FIG. 12, the swing arm mechanism 80 is in the enabled position and thus the arm enabling/disabling mechanism 121 securely latches the outwardly extending enable pin 156 into the first slot 152 of the latching plate 136. The biasing member 145 biases the latching plate 136 such that the outwardly extending enable pin 156 is securely engaged in the first slot 152.

FIG. 13 is a close-up upper view of the enabling/disabling mechanism 121 of FIGS. 11-13 with the swing arm mechanism 80 in the disabled position. Proximal to the latching plate 136 in the disabled position, an outwardly extending disable pin 158 extends from the exercise device. When the hand-gripping portion 92 of the swing arm mechanism 90 has been extended forward with the actuator 134 activated, the latching plate 136 extends rearward and receives the outwardly extending disable pin 158 in the second slot 154. Once the second slot 154 receives the disable pin 158, the actuator 134 can be released to cause the disable pin 158 to be releasably secured in the second slot 154. The latching plate 136 biasing member 145 biases latching plate 136 against the outwardly extending disable pin 158 to secure the swing arm mechanism 80 in the disabled position. Again, in further embodiments a locking mechanism or alternative fastening mechanisms could be employed to further releasably secure the outwardly extending enable pins 156, into the slots 152, 154, 158.

It is a further advantage of the present invention that when the swing arm assemblies 80, 90 are in the disabled position, the swing arm assemblies 80, 90 act as stationary arm grips for the user on the exercise device. In order to effectuate this, the coupling regions 86, 96 and the left and right hand-gripping portions 82, 92 of left and right swing arm mechanisms 80, 90 are advantageously shaped to provide both stationary arm grips in the disabled position and active arm action in the enabled position. Other configurations of the hand-gripping mechanisms also are contemplated.

To use the present invention, the user stands on the foot support portions 66, 76 and grasps the hand-gripping portions 82, 92. Initially, the arm mechanism is in the enabled position and thus the enabling/disabling mechanism is securely latched with the outwardly extending enable pin in the first slot of the latching plate. The user imparts a forward stepping motion on one of the foot support portions, thereby causing the transverse axle 34 to rotate in a clockwise direction (when viewed from the right side as shown in FIG. 1), due to the crank arm assemblies 40, 50 coupling the motion of the foot links 60, 70 to the rotation of the transverse axle 34. In conjunction with the lower body action, the user also imparts a substantially forward pushing motion on one of the hand-gripping portions and a substantially rearward pulling motion on the other hand-gripping portion. Due to the rotatable connection of the coupling regions 86, 96 of the swing arm mechanisms 80, 90 to the forward portions 62, 72 of the foot links 60, 70 (via the engagement assemblies), and the rotational securement of the swing arm mechanisms 80, 90 to the forward upright member 20 of the frame 12 at their pivot points 84, 94, each hand-gripping portion moves forward as its respective foot support portion moves rearward, and vice versa.

The foot links 60, 70 are attached to the transverse axle 34 by the crank arm assemblies 40, 50 such that one foot support portion moves substantially forward as the other foot support portion moves substantially rearward. In this same fashion one hand-gripping portion moves forward as the other hand-gripping portion moves rearward (e.g., when the left hand-gripping portion 82 moves forward, the left foot support portion 66 moves rearward, while the right foot support portion 76 moves forward and the right hand-gripping portion 92 moves rearward). Therefore, the user can begin movement of the entire foot link and swing arm mechanism linkage by moving any foot support portion or hand-gripping portion, or preferably by moving all of them together.

In the enabled position, to disable the arms, the user simply actuates the actuator and places the arms to the disengaged position. When the actuator is released, the outwardly extending disable pin is engaged in the second slot of the latching plate. In the disabled position, to re-enable the arms, the user simply actuates the actuator and returns the arms to the actuated position. When the actuator is released, the outwardly extending enable pin is again engaged in the first slot of the latching plate. Importantly, the user can effectuate either action—disengaging or engaging the arms—without stepping off the exercise device or, indeed, without interrupting the exercise regime.

While the exemplary embodiment described herein uses one embodiment of a mechanical enabling/disabling mechanism, other mechanical configurations also can be used. Additionally, other alternative embodiments for the enabling/disabling mechanism can include for example an electronic enabling/disabling mechanism such as for example an electronic solenoid mechanism coupled to an electronic switch through a wired or wireless connection. Further, the electronic switch or actuator can be voice activated. Other alternative embodiments of the enabling/disabling mechanism can include pneumatic and/or hydraulic components or mechanisms.

While the invention has been described with specific embodiments, other alternatives, modifications and variations will be apparent to those skilled in the art. For example, while the exemplary embodiment described herein requires the user to physically move the swing arm assemblies between the enabled and disabled positions, alternative embodiments can include a system that moves the swing arm assemblies between the enabled and disabled positions automatically utilizing, for example, biasing mechanisms such as for example springs or counter weights. Accordingly, it will be intended to include all such alternatives, modifications and variations set forth within the spirit and scope of the appended claims.

What is claimed is:

1. An exercise device, comprising:

a frame;

a foot link having a rearward portion that is constrained to move in an orbital path and a forward portion;

a swing arm having a pivotal connection to the frame, the swing arm including a hand gripping portion;

an engagement mechanism having a first portion coupled to the swing arm and a second portion coupled to the foot link; and an arm enabling/disabling mechanism operatively engaged with the swing arm, the arm enabling/disabling mechanism including an enabled position in which the swing arm is coupled to the foot link by the enabling/disabling mechanism such that the swing arm is fixed with respect to the foot link so that a force applied to the swing arm will produce a corresponding force on the forward portion of the foot link, and the arm enabling/disabling mechanism including a disabled position in which at least a portion of the swing arm is disengaged from the foot link and fixed with respect to the frame, the enabling/disabling mechanism comprising:

a latching member rotatable between (1) an engaged state in which the latching member latches the swing arm to either the foot link for the enabled position or the frame for the disabled position and (2) a disengaged state in which the swing arm is not fixed with respect to either the foot link or the frame;

a bias member applying a torque to the latching member to bias the latching member towards the engaged state; and a manual actuator configured to rotate the latching member against biasing of the bias member from the engaged state to the disengaged state in response to being manipulated by a user's hand while the user's hand remains in contact with the hand gripping portion;

wherein the latching member comprises a latching plate defining an enable slot and disable slot, and the exercise device further including an enable pin and a disable pin, such that when the enable pin is secured in the enable slot the swing arm is enabled and when the disable pin is secured in the disable slot the swing arm is disabled; and wherein the enable slot and the disable slot face both face in a same direction about a rotational axis of the latching plate, either a clockwise direction or a counter-clockwise direction.

2. The exercise device of claim 1, wherein at least a portion of the arm enabling/disabling mechanism is positioned on the swing arm.

3. The exercise device of claim 1, further including a left swing arm and a right swing arm, a left foot link and a right foot link, a left engagement mechanism and a right engagement mechanism, and a left arm enabling/disabling mechanism and a right arm enabling/disabling mechanism.

4. The exercise device of claim 1 further including a guide track, wherein the foot link includes at least one roller, and the guide track has an upper surface that is adapted to rollably receive the foot link roller and that reciprocally engages the guide track.

5. The exercise device of claim 1, further wherein the frame comprises a longitudinal member, an upright member extending upwardly from the longitudinal member and a transverse member extending outwardly transversely from the upright member and wherein the swing arm is pivotally connected to opposite portions of the transverse member.

6. The exercise device of claim 1, further comprising a flywheel, wherein the foot link is rotationally coupled to the flywheel with a crank arm assembly.

7. The exercise device of claim 1, further wherein the arm enabling/disabling mechanism can be effectuated by a user without the user interrupting exercise.

8. The exercise device of claim 1, further wherein in the disabled position the swing arm acts as a stationary arm grip.

9. The exercise device of claim 1, wherein the latching plate is carried by the swing arm and pivots relative to the frame when the latching member is in the disengaged state.

10. The exercise device of claim 1, wherein the latching plate is carried by the swing arm and pivots relative to the frame when the latching member is in the disengaged state.

11. The exercise device of claim 1, wherein the bias member comprises a spring.

12. An arm enabling/disabling mechanism for use with an elliptical exercise device having an arm mechanism, comprising:

a latching mechanism alternatively engaging and disengaging the arm mechanism; and an actuator contained proximate to a user using the exercise equipment, the actuator controlling the latching mechanism; whereby the arm enabling/disabling mechanism can be effectuated by a user without the user interrupting exercise, wherein the elliptical exercise device includes a foot link and the latching mechanism in an engaged position couples the arm mechanism to the foot link and wherein in a disengaged position the arm mechanism is not coupled to the foot link and wherein a latching plate of the latching mechanism is biased around a pivot point in opposition to the actuator, thereby providing biasing resistance to the actuator, wherein the latching mechanism includes: an enable pin extending from the arm enabling mechanism; a disable pin extending from the exercise device; and a latching plate including a first slot and a second slot facing in a same direction about a rotational axis of the latching plate, either a clockwise direction or a counter-clockwise direction, wherein the first slot and the second slot receive the enable pin and the disable pin to selectively enable movement of the arm mechanism and disable movement of the arm mechanism, respectively.

13. The arm enabling/disabling mechanism of claim 12, further wherein the arm enabling/disabling mechanism is pivotally connected to the elliptical exercise device.

14. The arm enabling/disabling mechanism of claim 13, further wherein the arm enabling/disabling mechanism comprises a double pivotal connection to the elliptical exercise device.

15. The arm enabling/disabling mechanism of claim 12, further wherein the disabled position comprises a second slot in the latching mechanism engaging an outwardly extending pin extending from the exercise device.

16. The arm enabling/disabling mechanism of claim 12, further wherein the actuator is connected to the latching mechanism by a cable.

17. The arm enabling/disabling mechanism of claim 12, further wherein the actuator is contained on the arm mechanism proximal to a hand-gripping portion such that the actuator controls the latching mechanism in response to manual manipulation by a person's hand while a person's hand remains in contact with the hand gripping portion.

18. The arm enabling/disabling mechanism of claim 12, further comprising a cable extending between the actuator and the latching mechanism, wherein actuator is a lever along a hand gripping portion of the arm mechanism.

19. The arm enabling/disabling mechanism of claim 12 further comprising a spring resiliently biasing the latching plate around a pivot point in opposition to the actuator.

20. The arm enabling such disabling mechanism of claim 12, wherein the latching mechanism is movable to a second engaged position in which the latching mechanism fixes the arm mechanism to a frame against any movement.

* * * * *